US006652265B2

(12) United States Patent
Cain

(10) Patent No.: US 6,652,265 B2
(45) Date of Patent: Nov. 25, 2003

(54) BURNER APPARATUS AND METHOD

(75) Inventor: Bruce E. Cain, Akron, OH (US)

(73) Assignee: North American Manufacturing Company, Cleveland, OH (US)

( * ) Notice: Subject to any disclaimer, the term of this patent is extended or adjusted under 35 U.S.C. 154(b) by 112 days.

(21) Appl. No.: 10/010,360

(22) Filed: Dec. 5, 2001

(65) Prior Publication Data

US 2002/0090583 A1 Jul. 11, 2002

Related U.S. Application Data

(60) Provisional application No. 60/251,905, filed on Dec. 6, 2000.

(51) Int. Cl.[7] ..... G03F 9/00; G03G 15/04; G03G 15/06

(52) U.S. Cl. ..... 431/6; 431/62; 431/72; 431/278; 431/285; 431/281

(58) Field of Search ..... 431/6, 62, 72, 431/278, 285, 281

(56) References Cited

U.S. PATENT DOCUMENTS

| | | | |
|---|---|---|---|
| 1,587,100 A | | 6/1926 | Willett |
| 3,273,621 A | | 9/1966 | Childree |
| 3,369,749 A | | 2/1968 | Siegmund et al. |
| 3,376,098 A | | 4/1968 | Pryor |
| 3,393,964 A | | 7/1968 | Donnelly |
| 3,727,562 A | | 4/1973 | Bauer |
| 3,729,285 A | | 4/1973 | Schwedersky |
| 3,736,747 A | | 6/1973 | Warren |
| 3,848,412 A | | 11/1974 | Michels et al. |
| 3,869,244 A | | 3/1975 | Von Linde et al. |
| 3,907,488 A | | 9/1975 | Takahashi et al. |
| 3,920,377 A | | 11/1975 | Yanuki et al. |
| 3,957,420 A | | 5/1976 | Asai et al. |
| 3,993,449 A | | 11/1976 | Childs |
| 3,994,670 A | | 11/1976 | Sheridan |
| 4,012,902 A | | 3/1977 | Schirmer |
| 4,021,186 A | | 5/1977 | Tenner |
| 4,035,137 A | | 7/1977 | Arand |
| 4,050,877 A | | 9/1977 | Craig et al. |
| 4,052,844 A | | 10/1977 | Caruel et al. |
| 4,094,625 A | | 6/1978 | Wang et al. |
| 4,095,929 A | | 6/1978 | McCartney |
| 4,113,417 A | | 9/1978 | Deruelle |
| 4,118,171 A | | 10/1978 | Flanagan et al. |
| 4,140,064 A | * | 2/1979 | Krakow ..... 108/42 |
| 4,351,632 A | | 9/1982 | Nagai |
| 4,388,062 A | | 6/1983 | Bartok et al. |
| 4,395,223 A | | 7/1983 | Okigami et al. |
| 4,496,306 A | | 1/1985 | Okigami et al. |
| 4,505,666 A | | 3/1985 | Martin et al. |
| 4,629,413 A | | 12/1986 | Michelson et al. |
| 4,669,398 A | | 6/1987 | Takahashi et al. |
| 4,669,399 A | | 6/1987 | Martin et al. |
| 4,945,841 A | | 8/1990 | Nakamachi et al. |
| 4,983,118 A | | 1/1991 | Hovis et al. |
| 4,995,807 A | | 2/1991 | Rampley et al. |
| 5,154,598 A | | 10/1992 | Gooderham et al. |

(List continued on next page.)

FOREIGN PATENT DOCUMENTS

| | | |
|---|---|---|
| DE | 23 37 517 A | 2/1975 |
| DE | 24 21 632 A | 11/1975 |
| DE | 197 28 965 A | 1/1998 |
| JP | 05 296447 A | 11/1993 |
| NL | 6 918 316 A | 6/1971 |

*Primary Examiner*—Alfred Basichas
(74) *Attorney, Agent, or Firm*—Jones Day

(57) ABSTRACT

A burner apparatus is operated in a plurality of distinct modes. In a startup mode, flows of oxidant and primary fuel are ignited by an igniter and are provided simultaneously with a flow of secondary fuel until a process chamber reaches the auto-ignition temperature of the secondary fuel. In a subsequent mode, flows of oxidant and secondary fuel are provided simultaneously to the exclusion of a flow of primary fuel.

13 Claims, 5 Drawing Sheets

U.S. PATENT DOCUMENTS 5,201,650 A 4/1993 Johnson
5,263,849 A 11/1993 Irwin et al.
5,284,438 A 2/1994 McGill et al.
5,295,820 A 3/1994 Bilcik et al.
5,368,476 A 11/1994 Sugahara et al.
5,395,235 A 3/1995 Lan-Sun Hung
5,407,345 A 4/1995 Robertson et al.
5,441,404 A 8/1995 Christenson
5,470,224 A 11/1995 Bortz
5,511,970 A * 4/1996 Irwin et al. ..... 431/9
5,522,721 A 6/1996 Drogue et al.
5,551,869 A 9/1996 Brais et al.
5,554,021 A 9/1996 Robertson et al.
5,584,684 A 12/1996 Dobbeling et al.
5,623,819 A 4/1997 Bowker et al.
5,626,017 A 5/1997 Sattelmayer
5,634,785 A 6/1997 Bury et al.
5,655,899 A 8/1997 Hura et al.
5,660,542 A 8/1997 Rinker et al.
5,667,376 A 9/1997 Robertson et al.
5,688,115 A 11/1997 Johnson
5,700,143 A 12/1997 Irwin et al.
5,713,206 A 2/1998 McWhirter et al.
5,722,821 A 3/1998 Christenson
5,730,591 A 3/1998 Robertson et al.
5,758,587 A 6/1998 Büchner et al.
5,772,421 A 6/1998 Besik et al.
5,803,725 A 9/1998 Horn et al.
5,813,846 A 9/1998 Newby et al.
5,863,193 A 1/1999 Tleimat
5,931,653 A 8/1999 Nakamachi
6,000,930 A 12/1999 Kelly et al.
6,206,686 B1 3/2001 Nieszczur et al.
6,315,552 B1 * 11/2001 Haynes et al. ..... 431/285

* cited by examiner

BURNER APPARATUS AND METHOD

This application claims priority to provisional patent application Ser. No. 60/251,905, filed Dec. 6, 2000.

FIELD OF THE INVENTION

The present invention relates to a burner apparatus and a method of operating the burner apparatus.

BACKGROUND

A burner is known to produce oxides of nitrogen ($NO_x$) during the combustion of fuel. $NO_x$ is generally produced by the combination of oxygen and nitrogen molecules supplied by the oxidant. It is sometimes desirable to reduce the level of $NO_x$.

SUMMARY

In accordance with the present invention, a method is provided for operating a burner apparatus. The burner apparatus defines a reaction zone and a process chamber adjoining the reaction zone. The burner apparatus includes a plurality of structures, to include an oxidant supply structure, which directs oxidant to flow into the reaction zone, and a primary fuel supply structure, which directs primary fuel to flow into the reaction zone for mixing with the oxidant to create a combustible mixture in the reaction zone. The burner apparatus further includes an igniter to ignite the combustible mixture in the reaction zone and initiate combustion that provides thermal energy to the process chamber. The burner apparatus also includes a secondary fuel supply structure that directs secondary fuel to flow into the process chamber.

The method includes providing flows of oxidant and fuel through the supply structures in a plurality of distinct modes. The modes include a startup mode. In the startup mode, flows of the oxidant and the primary fuel are ignited by the igniter and are provided simultaneously with a flow of the secondary fuel until the process chamber reaches the auto-ignition temperature of the secondary fuel. The modes further include a subsequent mode in which flows of the oxidant and the secondary fuel are provided simultaneously to the exclusion of a flow of the primary fuel.

The present invention also provides a particular configuration for the primary fuel supply structure in the burner apparatus. In accordance with this feature, the primary fuel supply structure is configured to direct the primary fuel into the reaction zone in a first concentration of fuel in a first region of the reaction zone remote from the secondary fuel inlet. The primary fuel supply structure further is configured to direct the primary fuel into the reaction zone in a second, greater concentration of fuel in a second region of the reaction zone between the first region and the secondary fuel inlet. As a result, combustion of the second concentration of fuel provides sufficient thermal energy to auto-ignite the secondary fuel adjacent to the secondary fuel inlet in the process chamber.

In accordance with another feature of the invention, the fuel supply structure includes a joint having an inlet communicating with the source of fuel, a primary fuel outlet communicating with the reaction zone, and a secondary fuel outlet communicating with the process chamber. The fuel line joint directs fuel from the inlet to the primary fuel outlet along a first flow path at a first flow rate. The joint further simultaneously directs fuel from the inlet to the secondary fuel outlet along a second flow path at a second flow rate. For a given inlet flow rate, the joint directs the fuel such that the ratio of the first flow rate to the second flow rate varies inversely with the inlet flow rate.

DESCRIPTION

Figure 1:
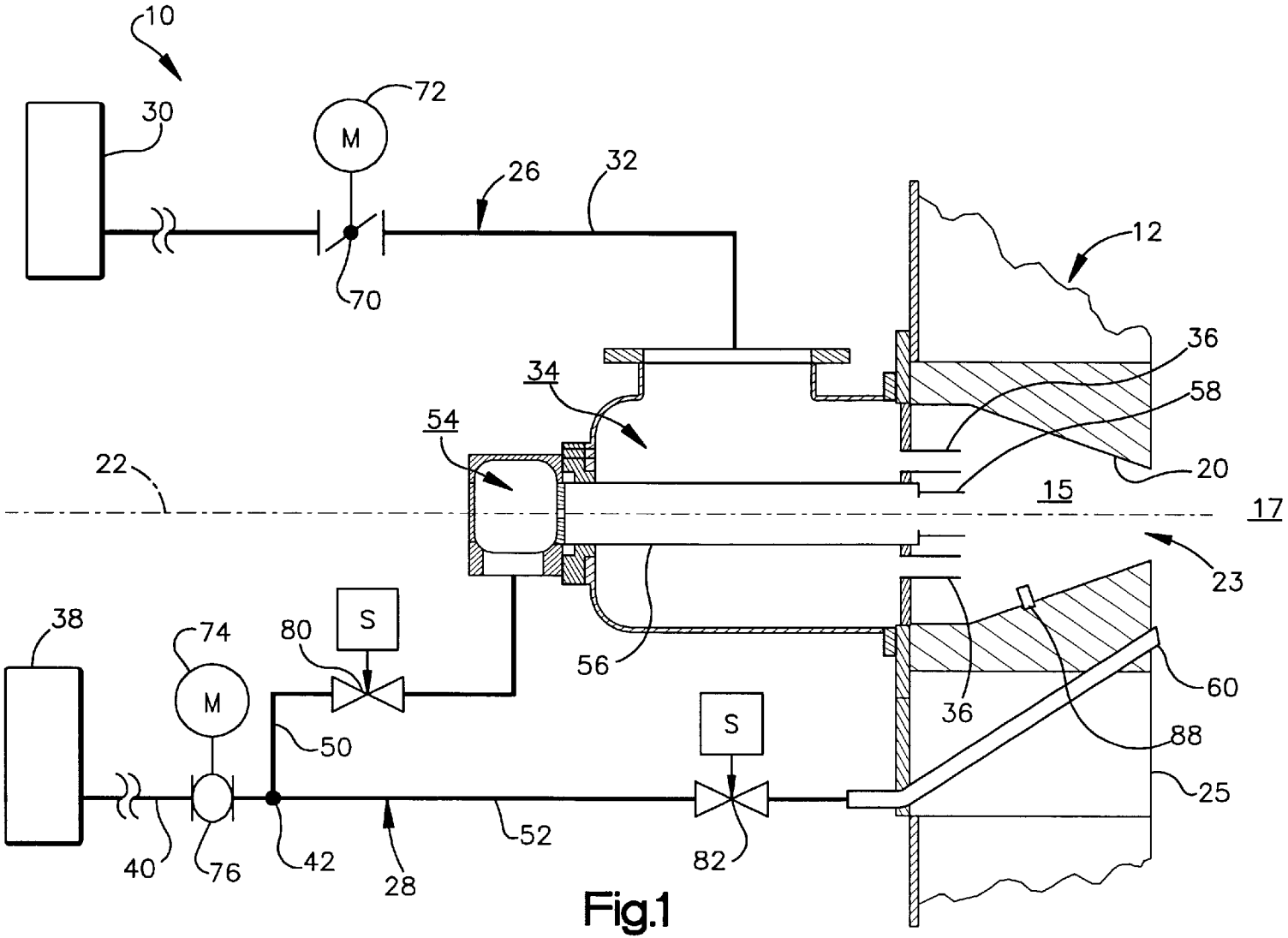
FIG. 1 is a schematic view of an apparatus comprising a first embodiment of the present invention.

An apparatus 10 comprising a first embodiment of the present invention is shown in FIG. 1. The apparatus 10 is a burner apparatus for use with, for example, a drying chamber for a coating process. A furnace structure 12 is part of the apparatus 10. The furnace structure 12 defines a reaction zone 15 and an adjoining process chamber 17. Part of the process chamber 17 is shown in FIG. 1.

The reaction zone 15 is defined by a furnace wall 20 and has a generally conical configuration centered on an axis 22. An open end 23 of the reaction zone 15 communicates directly with the process chamber 17 at an inner surface 25 of the furnace wall 20. Primary fuel and oxidant can be mixed in the reaction zone 15 to provide a combustible mixture in the reaction zone 15. Ignition of the combustible mixture initiates combustion of the combustible mixture to provide thermal energy through the open end 23 to the process chamber 17.

The apparatus 10 includes an oxidant supply structure 26 and a fuel supply structure 28. The oxidant supply structure 26 delivers oxidant from an oxidant source 30 through an oxidant supply line 32 to an oxidant plenum 34. A plurality of oxidant inlets 36 define open ends through which the oxidant plenum 34 can communicate with the reaction zone 15. The oxidant inlets 36 are preferably arranged in a circular array centered on the axis 22.

The fuel supply structure 28 delivers fuel from a fuel source 38 to the reaction zone 15 and/or the process chamber 17. A source line 40 delivers fuel from the fuel source 38 to a joint 42. At the joint 42, the source line 40 divides into a primary fuel line 50 and a secondary fuel line 52. The primary fuel line 50 delivers the primary fuel from the joint 42 to a primary fuel plenum 54. A main fuel conduit 56 is centered on the axis 22 and delivers the primary fuel from the primary fuel plenum 54 to the reaction zone 15 through a main fuel inlet 58. The main fuel inlet 58 defines an open end of the main fuel conduit 56.

The secondary fuel line 52 begins at the joint 42 and extends through the furnace structure 12 to a secondary fuel inlet 60 in the process chamber 17. The secondary fuel inlet 60 defines an open end of the secondary fuel line 52 and is located near the surface 25 spaced from the open end 23 of the reaction zone 15. When secondary fuel is supplied by the secondary fuel line 52, the secondary fuel inlet 60 directs a solitary stream of secondary fuel into the process chamber 17.

Also included in the apparatus 10 is a plurality of actuatable motorized valves. The plurality of motorized valves includes an oxidant valve 70 interposed in the oxidant supply line 32 between the oxidant source 30 and the oxidant plenum 34. The oxidant valve 70 is operated by an oxidant valve motor 72. The amount of oxidant introduced into the reaction zone 15 through the oxidant inlets 36 can be controlled by actuating the oxidant valve motor 72.

Other motorized valves include a fuel source valve 76, a primary fuel valve 80, and a secondary fuel valve 82. The fuel source valve 76 is interposed between the fuel source 38 and the joint 42. The fuel source valve motor 74 operates the fuel source valve 76. The primary fuel valve 80 is interposed between the joint 42 and the primary fuel plenum 54. The secondary fuel valve 82 is interposed between the joint 42 and the secondary fuel inlet 60.

An igniter 88 is provided in or near the reaction zone 15. It can ignite a combustible mixture in the reaction zone 15. The igniter 88 can be, for example, a pilot flame or a glow wire, as known in the art.

Figure 2:
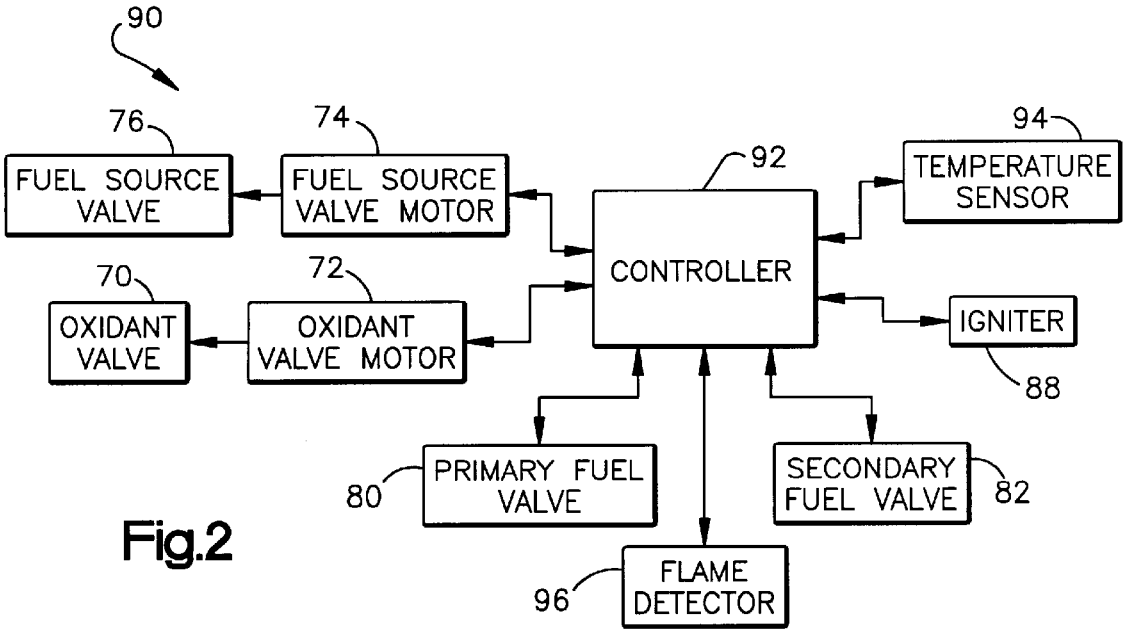
FIG. 2 is a block diagram of a control system for the apparatus of FIG. 1.

With reference to FIGS. 1 and 2, the apparatus 10 further includes a control system 90. The control system 90 includes a controller 92 that is operatively interconnected with other parts of the apparatus 10, as shown in FIG. 2. These parts include the motors and valves described above, and further include a temperature sensor 94, a flame detector 96, and the igniter 88. The controller 92 is responsive to the temperature sensor 94 and the flame detector 96. The flame detector 96 signals the controller 92 as to whether a flame is present in the reaction zone 15 or, alternatively, in the process chamber 17. As a result, the controller 92 can act as a safety shutoff for the fuel and/or oxidant in the event that, for example, the flame detector 96 signals to the controller 92 that no flame is present in the reaction zone 15.

Figure 3:
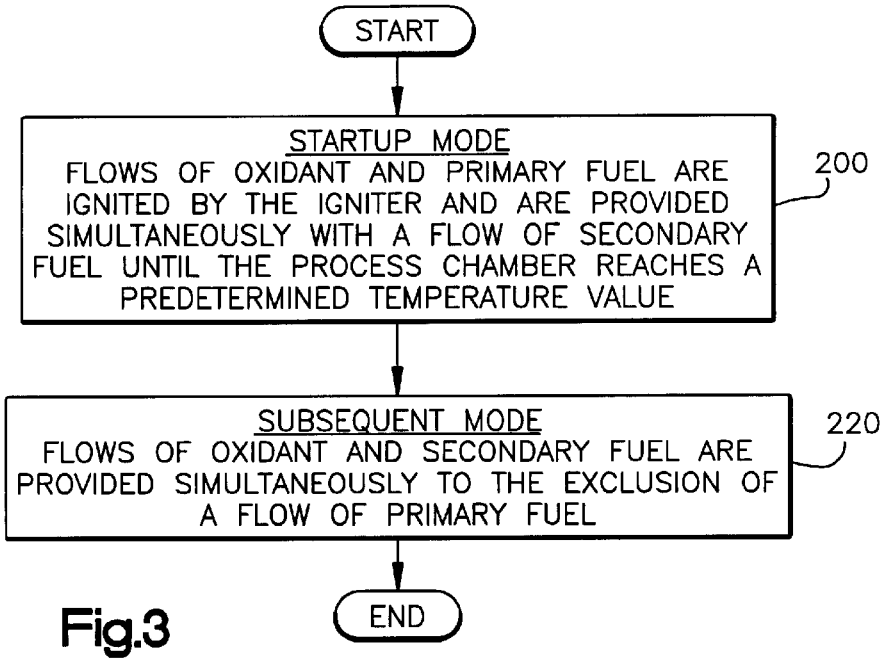
FIG. 3 is a flow chart of a method of operating the apparatus of FIG. 1.
Figure 4:
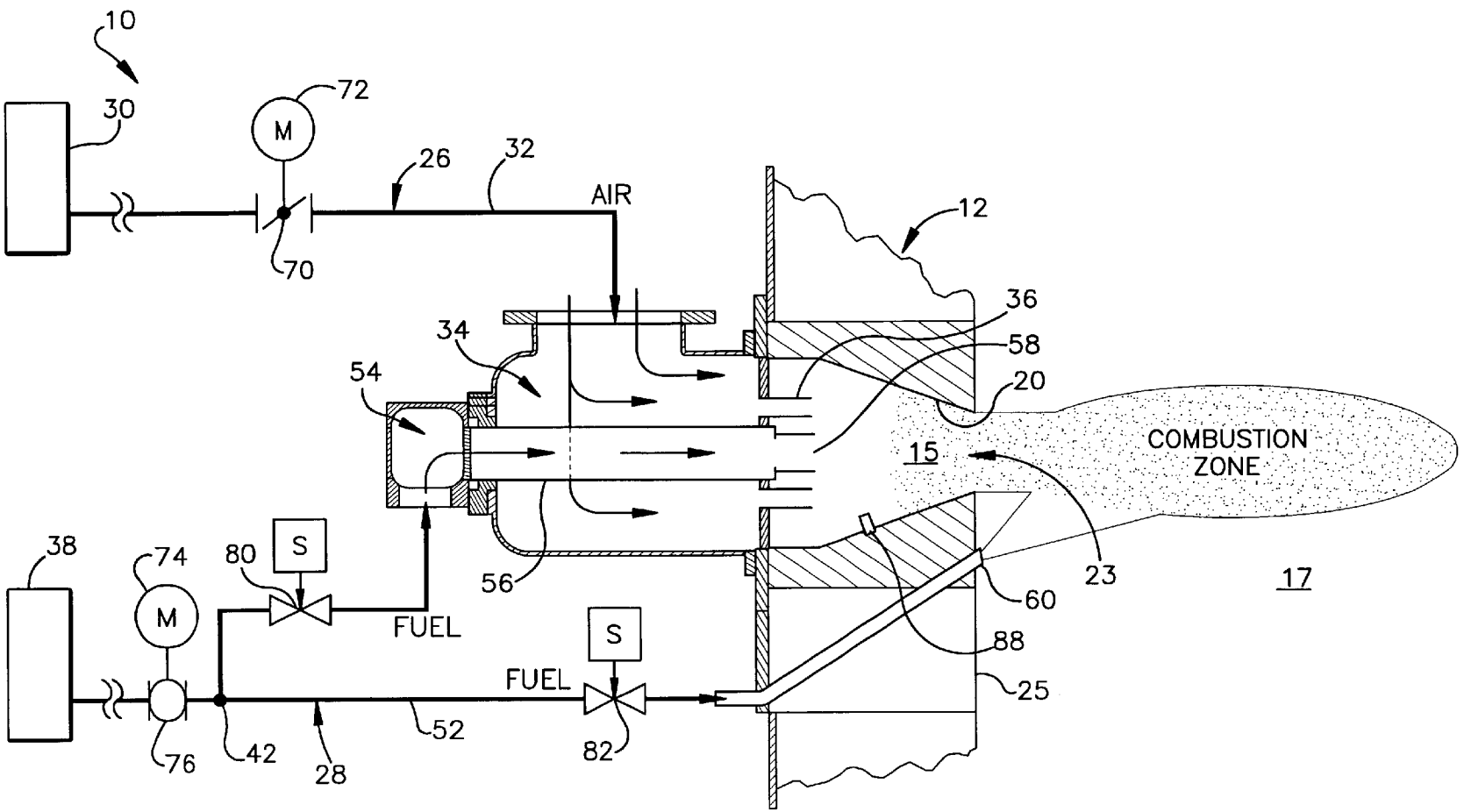
FIG. 4 is a schematic view of the apparatus of FIG. 1 operating in a first mode.

As shown in FIG. 3, the controller 92 operates the apparatus 10 in a plurality of distinct modes. Specifically, the controller 92 can operate in a first mode 200 and in a subsequent mode 220. In accordance with this embodiment, the controller 92 begins with the first mode 200, which is a startup mode and is shown in FIG. 4. In the first mode 200, the controller 92 actuates the oxidant valve motor 72 and the fuel source valve motor 74. The motors 72 and 74 respond by opening the oxidant valve 70 and the fuel source valve 76, respectively. The opening of the oxidant valve 70 creates a continuous open flow path from the oxidant supply source 30 to the oxidant inlets 36. The opening of the fuel source valve 76 creates a continuous open flow path from the fuel source 38 to the primary and secondary fuel valves 80 and 82.

Also, the controller 92 signals, and thereby opens, the primary fuel valve 80 and the secondary fuel valve 82. This extends the continuous open flow path from the fuel source 38 to the main fuel inlet 58 and the secondary fuel inlet 60. Therefore, in the first mode 200, fuel is simultaneously supplied through the main fuel inlet 58 and the secondary fuel inlet 60. The primary fuel is directed into the reaction zone 15 by the main fuel inlet 58 where it mixes with the oxidant supplied through the oxidant inlets 36 to form a combustible mixture in the reaction zone 15.

As noted above, in the first mode 200, secondary fuel is supplied simultaneously with primary fuel. The secondary fuel is directed into the process chamber 17 through the secondary fuel inlet 60.

The combustible mixture in the reaction zone 15 is ignited by the igniter 88 when the controller 92 actuates the igniter 88. The ignition of the combustible mixture creates a flame that extends from the reaction zone 15 into the process chamber 17 to provide thermal energy to the process chamber 17. This is shown in FIG. 4. The thermal energy provided to the process chamber 17 by the flame extending from the reaction zone 15 causes ignition of the secondary fuel stream. The controller 92 monitors the temperature of the process chamber 17 with the temperature sensor 94. Operation of the apparatus 10 in the first mode 200 continues until the temperature in the process chamber 17 reaches a predetermined value.

Figure 5:
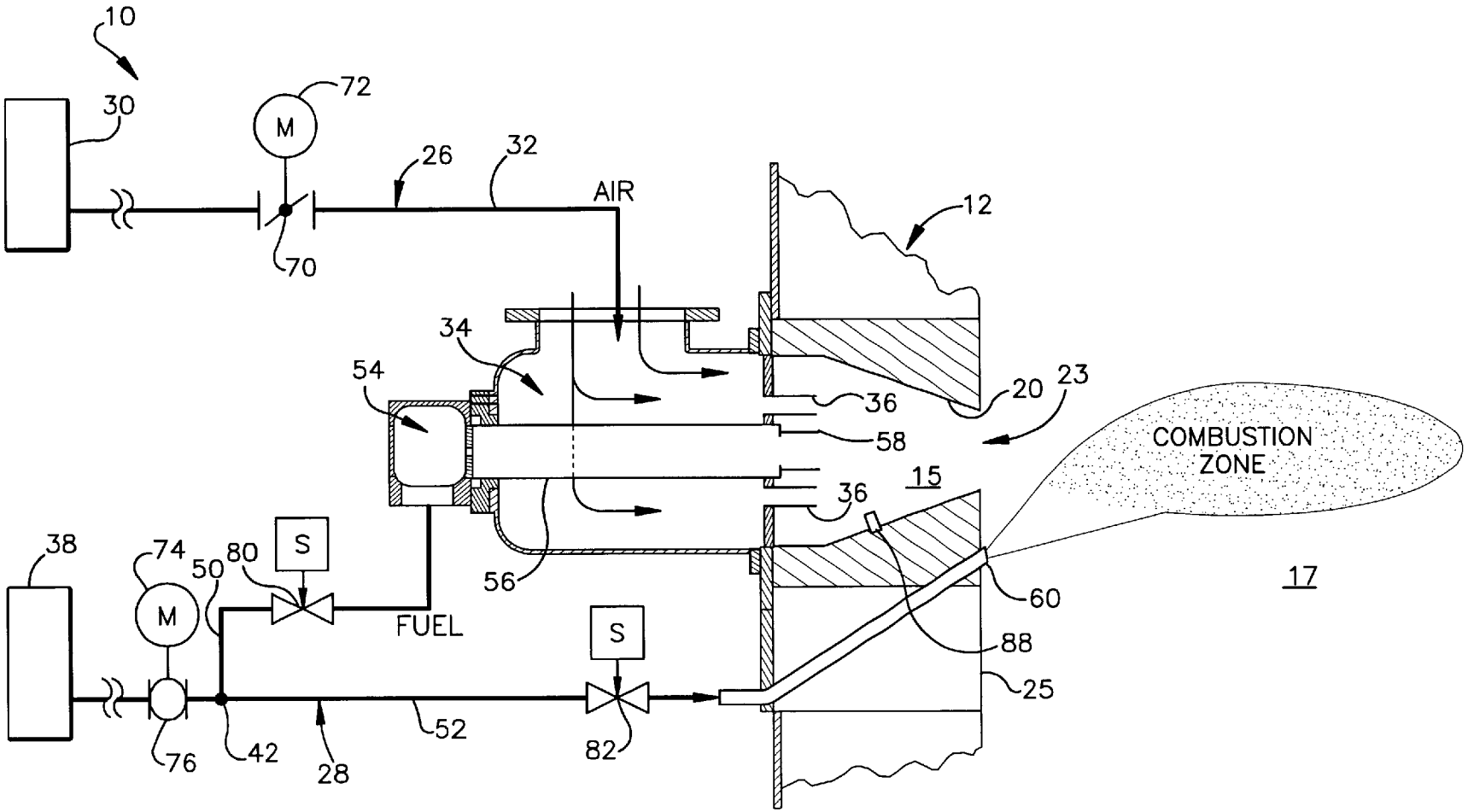
FIG. 5 is a schematic view of the apparatus of FIG. 1 operating in a second mode.

The temperature sensor 94 senses when the temperature in the process chamber 17 reaches the predetermined temperature value. In this embodiment, the predetermined temperature value can be any temperature at or above the auto-ignition temperature of the secondary fuel. The controller 92, which is monitoring the temperature sensor 94, ends the first mode 200 and begins the second, subsequent mode 220. FIG. 5 shows the apparatus 10 operating in the subsequent mode 220.

To switch to the subsequent mode 220, the controller 92 signals the primary fuel valve 80 causing it to close. Closing the primary fuel valve 80 stops the flow of the primary fuel through the primary fuel line 50. Flows of the oxidant and the secondary fuel are then provided simultaneously to the exclusion of a flow of the primary fuel. The flow of secondary fuel in the second, subsequent mode 220 can increase to accommodate the decrease in the flow of primary fuel. Because the temperature in the process chamber 17 is at or above the auto-ignition temperature of the secondary fuel, the secondary fuel auto-ignites upon its introduction into the process chamber 17. Combustion of the secondary fuel in the process chamber 17 provides thermal energy to process chamber 17.

The subsequent mode 220, which may be referred to as an operational mode, can continue as long as it is desirable to keep the temperature in the process chamber 17 at or above the auto-ignition temperature of the secondary fuel. In addition, the temperature of the process chamber 17 can be constant and/or can vary while operating in the subsequent mode 220. A variation in the temperature of the process chamber 17 can be either an increase or decrease, provided that the temperature remains above the auto-ignition temperature of the secondary fuel. For example, the temperature in the process chamber 17 can be cycled, can ramp up or down, or can change as necessary.

The operation of the apparatus 10 in the first mode 200 produces amounts of $NO_x$ in a range that is between the amounts of $NO_x$ produced by the combustion of only primary fuel or the combustion of only secondary fuel by the apparatus 10. For example, in proportion to the amount of thermal energy generated, smaller amounts of $NO_x$ are produced while operating in the first mode 200 than would be produced if only the primary fuel/oxidant was supplied to the reaction zone 15 and combusted.

In comparison with operation in the first mode 200, when the apparatus 10 operates in the subsequent mode 220, a lower amount of $NO_x$ can be produced. Further, the amount of $NO_x$ production in the subsequent mode 220 can also be reduced compared to when the apparatus 10 operates with only the primary fuel/oxidant mixture being combusted in the reaction zone 15.

Figure 6:
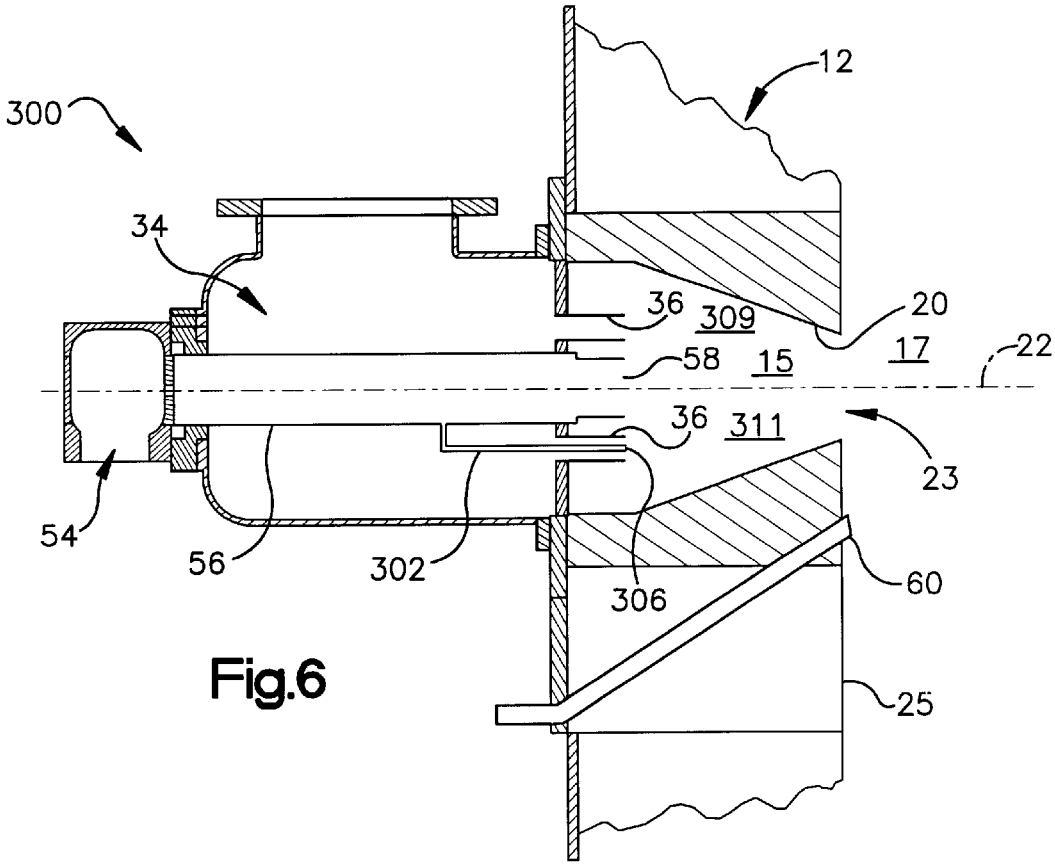
FIG. 6 is a schematic view of an apparatus comprising a second embodiment of the present invention.

An apparatus 300 comprising a second embodiment of the invention is shown in FIG. 6. This embodiment has many parts that are substantially the same as corresponding parts of the first embodiment shown in FIG. 1. This is indicated by the use of the same reference numbers for such corresponding parts in FIGS. 1 and 6. The apparatus 300 differs from the apparatus 10 in that a branch fuel conduit 302 is included in apparatus 300. The branch fuel conduit 302 conveys primary fuel from the main fuel conduit 56 to the reaction zone 15 via a branch fuel inlet 306. The branch fuel inlet 306 is spaced radially from the main fuel inlet 58. In this embodiment, the branch fuel inlet 306 enters the reaction zone 15 between the main fuel inlet 58 and the secondary fuel inlet 60.

The main fuel inlet 58 and the branch fuel inlet 306 together form a total flow area into the reaction zone 15 that is asymmetrical with reference to the axis 22. The main fuel inlet 58 directs the primary fuel into the reaction zone 15 in a first concentration of fuel in a first region 309 of the reaction zone 15 that is remote from the secondary fuel inlet 60. A second region 311 receives about the same amount of primary fuel from the main fuel inlet 58 as the first region 309. But, the branch fuel inlet 306 directs a second amount of fuel into the second region 311 of the reaction zone 15. That is, the second region 311 also receives additional primary fuel through the branch fuel inlet 306. The combination of the fuel supplied by the main fuel inlet 58 and the branch fuel inlet 306 results in a greater ratio of fuel to oxidant in the second region 311 compared to the first region 309. Combustion of the greater concentration of primary fuel in the second region 311 results in a corresponding, greater amount of thermal energy being generated in the second region 311 than in the first region 309.

The second region 311 is between the first region 309 and the secondary fuel inlet 60. Therefore, the second region 311 is more near the secondary fuel inlet 60 than the first region 309. Because the second region 311 is more near the secondary fuel outlet 60, combustion of primary fuel in the second region occurs more near the secondary fuel outlet 60. The greater amount of thermal energy generated in the second region 311 during combustion of the primary fuel helps to ensure auto-ignition of the secondary fuel in the process chamber 17.

Figure 7:
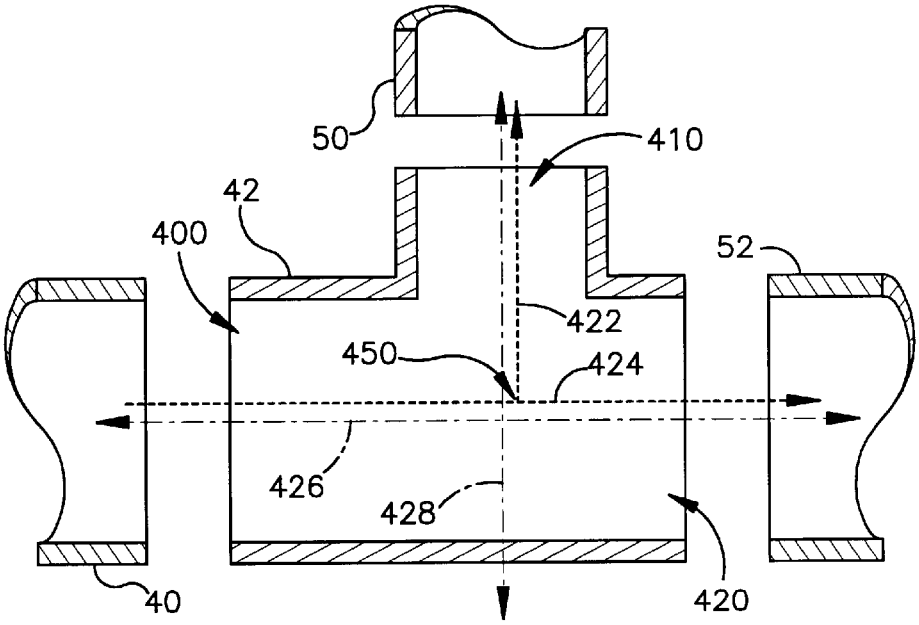
FIG. 7 is an enlarged, exploded view of a fuel line configured in accordance with the present invention.

In each of the embodiments shown above, the joint 42 has a specific configuration as shown in FIG. 7. The joint 42 has openings that include a fuel inlet 400 communicating with the fuel source line 40. The openings also include a primary fuel outlet 410 communicating with the primary fuel line 50, and a secondary fuel outlet 420 communicating with the secondary fuel line 52.

In this embodiment, the joint 42 is "T" shaped and directs fuel from the fuel inlet 400 to the primary fuel outlet 410 along a first flow path 422 at a first flow rate, and to the secondary fuel outlet 420 along a second flow path 424 at a second flow rate. The first flow path 422 and the second flow path 424 are coextensive between the inlet 400 and a divergence location 450, and are separate from each other between the divergence location 450 and the primary and secondary outlets 410 and 420.

The second flow path 424 is centered on a main axis 426 and is straight from the fuel inlet 400 to the secondary fuel outlet 420. The first flow path 422 is centered on a minor axis 428 that is orthogonal to the main axis 426 between the divergence location 450 and the primary fuel outlet 410.

Because some of the fuel must turn to follow the first flow path 422, there is a greater resistance to flow along the first flow path 422 compared to the second flow path 424. The resistance along the first flow path 422 increases as the flow rate through the joint 42 increases. In accordance with known principles of fluid dynamics, fluids follow the path of least resistance. Thus, when the flow rate through the joint 42 increases, more fuel goes straight through the joint 42 along the straight, second flow path 422 relative to the amount of fuel that turns and follows the first flow path 422. As the flow rate increases through the joint 42, proportionally more fuel is delivered to the secondary fuel outlet 420 and proportionally less fuel flows to the primary fuel outlet 410. Accordingly, the ratio of the first flow rate to the second flow rate decreases when the flow rate through the joint 42 increases. Conversely, as the amount of fuel supplied to the fuel source inlet 400 decreases there is proportionally more primary fuel supplied in relation to secondary fuel supplied for combustion purposes.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method of operating a burner apparatus defining a reaction zone, a process chamber adjoining said reaction zone, an oxidant supply structure configured to direct oxidant to flow into said reaction zone, a primary fuel supply structure configured to direct primary fuel gas to flow into said reaction zone for mixing with said oxidant to create a combustible mixture in said reaction zone, an igniter operative to ignite said combustible mixture in said reaction zone and thereby to initiate combustion that provides thermal energy to said process chamber, and a secondary fuel supply structure configured to direct secondary fuel gas to flow into said process chamber, said method comprising:

providing input flows of oxidant and fuel gas through said supply structures in a plurality of distinct combustion modes;

said combustion modes including a startup combustion mode in which input flows of said oxidant and said primary fuel gas are ignited by said igniter and are provided simultaneously with an input flow of said secondary fuel gas until said process chamber reaches the auto-ignition temperature of said secondary fuel gas;

said modes further including a subsequent combustion mode in which input flows of said oxidant and said secondary fuel gas are provided simultaneously to the exclusion of an input flow of said primary fuel gas.

2. A method as defined in claim 1 wherein said subsequent combustion mode, in which input flows of said oxidant and said secondary fuel gas are provided simultaneously, immediately follows said startup combustion mode.

3. A method as defined in claim 1 wherein said input flow of said secondary fuel gas in said subsequent combustion mode is controlled to be equal to the total fuel gas input flow of said primary and said secondary fuel gas input flows in said startup combustion mode.

4. An apparatus comprising:

a furnace structure defining a reaction zone and a process chamber adjoining said reaction zone;

an oxidant supply structure configured to direct oxidant into said reaction zone;

a primary fuel supply structure configured to direct primary fuel gas into said reaction zone for mixing with said oxidant to create a combustible mixture in said reaction zone;

an igniter operative to ignite said combustible mixture in said reaction zone and thereby to initiate combustion that provides thermal energy to said process chamber; and a secondary fuel supply structure configured to direct secondary fuel gas to flow into said process chamber at a secondary fuel inlet in said process chamber;

said primary fuel supply structure being further configured to direct said primary fuel gas into said reaction zone in a first concentration of fuel gas in a first region of said reaction zone remote from said secondary fuel inlet, and to direct said primary fuel gas into said reaction zone in a second concentration of fuel gas in a second region of said reaction zone between said first region and said secondary fuel inlet, whereby combustion of said second concentration of fuel gas provides thermal energy adjacent to said secondary fuel inlet sufficient to auto-ignite said secondary fuel gas in said process chamber.

5. An apparatus as defined in claim 4 wherein said primary fuel supply structure has a total inlet flow area in said reaction zone and said total inlet flow area is asymmetrical with reference to said reaction zone.

6. An apparatus as defined in claim 5 wherein said asymmetrical total fuel inlet flow area is configured to direct a first portion of primary fuel gas into said first region and a second portion of primary fuel gas into said second region.

7. An apparatus as defined in claim 4 wherein said reaction zone has a central axis, and said primary fuel supply structure includes a main fuel inlet centered on said axis, and further includes a branch fuel inlet spaced radially from said main fuel inlet.

8. An apparatus as defined in claim 7 wherein said main fuel inlet is configured to provide a first amount of said primary fuel gas, and said branch fuel inlet is configured to supply a second amount of said primary fuel gas for a given flow of primary fuel gas through said primary fuel supply structure.

9. An apparatus comprising:

a furnace structure defining a reaction zone and a process chamber adjoining said reaction zone;

an oxidant supply structure configured to direct oxidant to flow from a source of oxidant into said reaction zone; and a fuel supply structure configured to direct primary fuel gas to flow from the source of fuel into said reaction zone for mixing with said oxidant to create a combustible mixture in said reaction zone, and to direct secondary fuel gas to flow into said process chamber, said fuel supply structure including a fuel line joint;

said joint having an inlet communicating with the source of fuel, a primary fuel outlet communicating with said reaction zone, and a secondary fuel outlet communicating with said process chamber;

said joint being configured to direct fuel gas from said inlet to said primary fuel outlet along a first input flow path at a first input flow rate, and simultaneously to direct fuel gas from said inlet to said secondary fuel outlet along a second input flow path at a second input flow rate for a given inlet input flow rate such that the ratio of said first input flow rate to said second input flow rate varies inversely with said inlet input flow rate.

10. An apparatus as defined in claim 9 wherein said joint is T shaped.

11. An apparatus as defined in claim 9 wherein said first input flow path and said second input flow path are coextensive between said inlet and a divergence location, and diverge in said joint at said divergence location, and said first and second input flow paths are separate from each other between said divergence location and said outlets.

12. An apparatus as defined in claim 11 wherein said first input flow path is orthogonal to said second input flow path between said divergence location and said primary fuel outlet.

13. An apparatus as defined in claim 11 wherein said second input flow path is straight from said inlet to said secondary fuel outlet.

* * * * *